United States Patent [19]

Girod et al.

[11] Patent Number: 4,461,217

[45] Date of Patent: Jul. 24, 1984

[54] MOTORIZED RAILWAY BOGIE

[75] Inventors: Hanjochen Girod; Gerhard Korn, both of Mülheim, Fed. Rep. of Germany

[73] Assignee: Thyssen Industrie AG, Fed. Rep. of Germany

[21] Appl. No.: 477,364

[22] Filed: Mar. 21, 1983

Related U.S. Application Data

[63] Continuation of Ser. No. 177,838, Aug. 14, 1980, abandoned.

[30] Foreign Application Priority Data

Aug. 21, 1979 [DE] Fed. Rep. of Germany ..... 2933706

[51] Int. Cl.[3] ..... B61C 9/50; B61C 9/52; B61F 3/04; B61F 3/16

[52] U.S. Cl. ..... 105/135; 105/136; 105/182 R; 105/218 A

[58] Field of Search ..... 105/131, 132, 133, 135, 105/136, 180, 182 R, 218 A

[56] References Cited

U.S. PATENT DOCUMENTS

| | | | |
|---|---|---|---|
| 568,779 | 10/1896 | Lockwood | 105/131 X |
| 2,023,756 | 12/1935 | Brownyer | 105/218 A X |
| 2,036,194 | 4/1936 | Burrows et al. | 105/135 X |
| 2,059,963 | 11/1936 | Barrows | 105/218 A X |
| 2,411,978 | 12/1946 | Porteus | 105/180 |
| 2,620,742 | 12/1952 | Water | 105/180 |
| 2,892,420 | 6/1959 | Cooper | 105/180 X |
| 3,626,862 | 12/1971 | Korn et al. | 105/131 |
| 3,990,372 | 11/1976 | Eggert et al. | 105/135 |
| 4,164,188 | 8/1979 | Hallam et al. | 105/135 X |

FOREIGN PATENT DOCUMENTS

| | | | |
|---|---|---|---|
| 566698 | 12/1932 | Fed. Rep. of Germany | 105/135 |
| 1908176 | 9/1970 | Fed. Rep. of Germany | 105/131 |
| 2548058 | 4/1977 | Fed. Rep. of Germany | 105/135 |

*Primary Examiner*—Howard Beltran

*Attorney, Agent, or Firm*—McGlew and Tuttle

[57] ABSTRACT

A bogie for a rail vehicle comprises a hollow jacket having opposite open end faces forming an electric motor housing. A stator winding assembly is press fit into the hollow jacket and receives a rotatably mounted motor shaft which has an axis extending parallel to the direction of travel of the rail vehicle. A cross-beam having side parts is connected directly, for example, by welding to the hollow jacket. A motor bearing bracket is connected and closes the opposite end faces of the hollow jacket and carries a bearing through which the motor shaft is mounted. The motor shaft is connected to a miter gear, a differential gear, Cardan shafts and couplings, to bogie wheels. Double linkages may be connected to axles of the wheels with wheels on opposite sides of the bogie and at either end of the bogie having linkages which are connected to each other.

4 Claims, 5 Drawing Figures

MOTORIZED RAILWAY BOGIE

This is a continuation of Ser. No. 177,838 filed Aug. 14th, 1980 and now abandoned.

FIELD AND BACKGROUND OF THE INVENTION

The invention relates, in general, to rail vehicles, and in particular to a new and useful bogie for rail cars, with a driving motor having an axis arranged in the traveling direction of the rail car at the end face of which is arranged a miter gear which is connected over a differential gear by means of cardan shafts and couplings with the wheels of a bogie axle mounted in cradle frames or links.

It is known to drive the axles of a bogie for rail cars, like street cars, with a driving motor arranged in the traveling direction over a miter gear arranged on its end faces and over a hollow shaft surrounding the axle with play and with corresponding connecting couplings.

In this type of bogie the wheels, which are rigidly connected with each other over the axle, compensate for the various path lengths on curves in the rail, mostly automatically by the cone-type inclination of their wheel rim. This longitudinal compensation is accompanied by a varying degree of sliding friction, by flange or rim wear, and by unpleasant screeching noises which are produced under certain circumstances.

In order to eliminate these disadvantages, the wheels in the prior art were arranged on separate axles, instead of on axles which rigidly connected the wheels.

SUMMARY OF THE INVENTION

A hitherto unpublished proposal suggests the driving of the wheels by a single motor arranged in the center of the vehicle and in a traveling direction, with two driven shaft ends and over miter gears, differential gears, clutches and cardan shafts.

Such bogies are relatively heavy and do not take into account the trends toward lightweight construction and toward high speed vehicles.

The problem underlying the invention is to eliminate these disadvantages and to provide a bogie with center drive which is substantially lighter than the presently known bogies. The invention consists in that the motor is held in known manner in the crossbeam connecting the side parts of the bogie and provided with a hollow jacket, where the hollow jacket is designed as an electric motor housing into which the stator windings are pushed and which is closed at the end face by motor bearing brackets.

It is already known, for example, from German Pat. No. 566,698 to provide the transverse connection of the longitudinal bogie girders in bogies with continuous rigid axles with a housing receiving the motor. But this housing acting as a mount does not have the function of a motor jacket. By inserting the motor housing proper into this mount, this construction is still very heavy.

The hollow jacket is preferably closed directly by the flanges of the miter gears, eliminating special motor bearing brackets, and the motor shaft is mounted in known manner in the pinion bearings of the miter gears. The use of the pinion bearings of the miter gears for supporting the motor shaft is already known from DOS No. 25 48 058, where it serves particularly to shorten the length of the motor. In the present case it serves particularly to further reduce weight.

Another measure, which likewise serves to reduce the weight of the bogie, consists in that double-walled links enclose each one of the wheels and form a frame together with elements which connect the opposite ends of the links of a bogie axle with each other, and which are jointed at the ends remote from the bogie center, e.g. over silent blocks, with the side parts of the bogie, and bear in their center, with the interposition of a spring assembly, on an arm of the side parts.

It was found of particular advantage to effect the connection of one of the links of a bogie axle with the side part of the bogie by a double joint, which is arranged diagonally opposite the double joint of the other bogie axle. The use of these double joints facilitates the settings of the axles, which happens, e.g. in overriding of the rail by a wheel flange.

Preferably the elements which connect the links of a bogie axle to a frame, are designed as thin-walled tubes and are made of light metal, if necessary. The links too can consist of the same material. This construction is therefore easy to produce.

The wheels mounted between the walls of each link individually are arranged absolutely parallel to each other by the frame-type connection of the links of a bogie axle. The wheels need not be spring-mounted in the links, the links and the wheels are rather sprung jointly.

Accordingly, an object of the invention is to provide a bogie for a rail vehicle comprising, a hollow jacket having at least on open face and forming an electric motor housing, a stator winding assembly in said hollow jacket, a rotatably mounted motor shaft in said stator winding assembly having an axis extending in a travel direction of the vehicle, a cross-beam having side parts and connected directly to said hollow jacket, a motor bearing bracket connected to and covering said end face of said hollow jacket for rotatably receiving said motor shaft, a miter and differential gear housing connected to said bracket and including therein a miter and differential gear connected to said motor shaft, a pair of Cardan shafts with couplings connected to said miter and differential gear, and a wheel connected to each of said Cardan shafts and couplings.

A further object of the invention to provide a bogie for a rail vehicle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

An embodiment of the invention is represented schematically in the drawings and described more fully below wherein.

DESCRIPTION OF THE PREFERRED EMBODIMENTS

Figure 1:
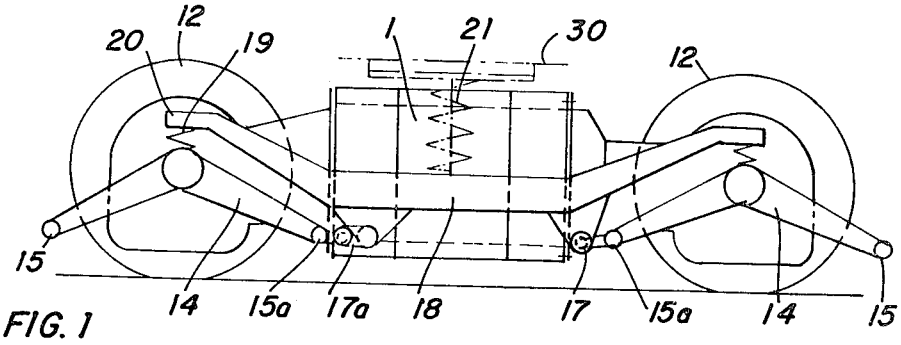
FIG. 1 is a side elevation of a bogie driven by an electromotor.
Figure 3:
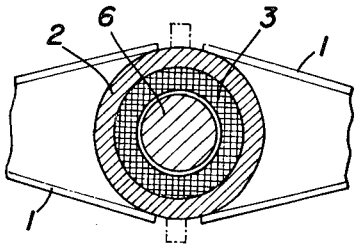
FIG. 3 is a cross sectional view through the electromotor.

Referring to the drawings, in particular, the invention embodied therein, in FIG. 1, comprises an element shown at numeral 1 which is a bolster or crossbeam which connects the side frames or parts 18 of the bogie. Crossbeam 1 is designed to form the side frames or parts 18 in one piece. Crossbeam 1 carries in the longitudinal center of the bogie, a welded-in, hollow jacket 2 which serves as an electric motor housing for the bogie drive. The jacket 2 directly receives the stator windings. Hollow jacket 2 can likewise be divided in the longitudinal direction, as indicated in FIG. 3 in broken lines, so that the assembly of stator windings 3 is facilitated.

Figure 2A:
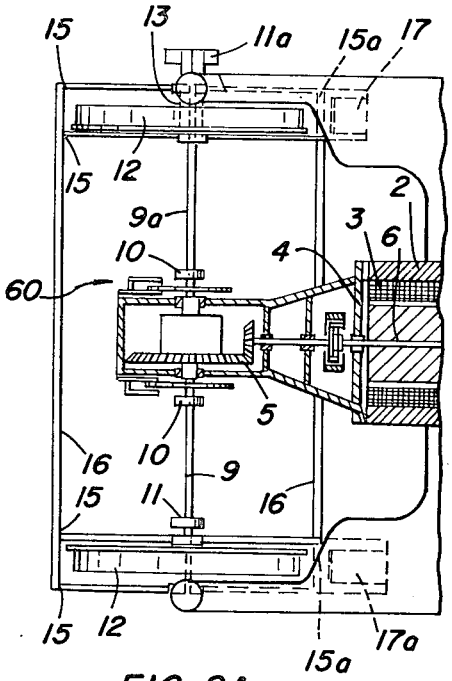
FIGS. 2A and 2B are each fragmentary top plan views of FIG. 1, partially in section and showing different motor designs.
Figure 2B:
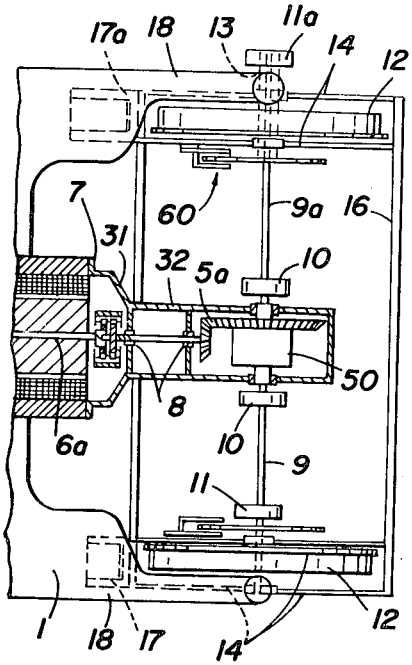

Hollow jacket 2 is closed, as shown in FIG. 2A, at its end face, with a bearing bracket 4, against which bears a miter gear housing with miter gear 5 secured on the hollow jacket 2 by bolts or the like, and in which a rotor shaft 6 of the motor is mounted. In the embodiment of FIG. 2B, which jacket 2 is closed directly by flange 7 of bearing bracket 31 which forms a part of housing 32 for containing miter gear **5*a* and a rotor shaft 6*a* mounted on bearings 8 of the pinion of miter gear 5*a*. Miter gears 5 or 5*a* (in FIGS. 2A and 2B respectively) drive wheels 12 over Cardan shafts 9 and 9*a* and hinge couplings 10, 11 and 11*a*, and through differentials 50. These are mounted on hollow shafts 13 of wheels 12 in the upper part of FIGS. 2A and 2B in order to maintain a maximum hinge interval of the Cardan shaft 9*a* in cases where the Cardan shaft 9*a* penetrates through hollow shaft 13 and is connected with shaft 13 by hinge coupling 11*a*, which is on the outside of the bogie (top side of FIGS. 2A and 2B**).

Wheels 12 are mounted in links 14 which each have two webs extending parallel to each other in the traveling direction and which enclose a wheel 12 with links 14 on each side of each wheel. Two links 14 of a bogie axle are also connected with each other at the opposite ends 15 and **15*a* thereof, by thin-walled tubes 16** so that a yoke-type structure is formed together with the links.

Figure 4:
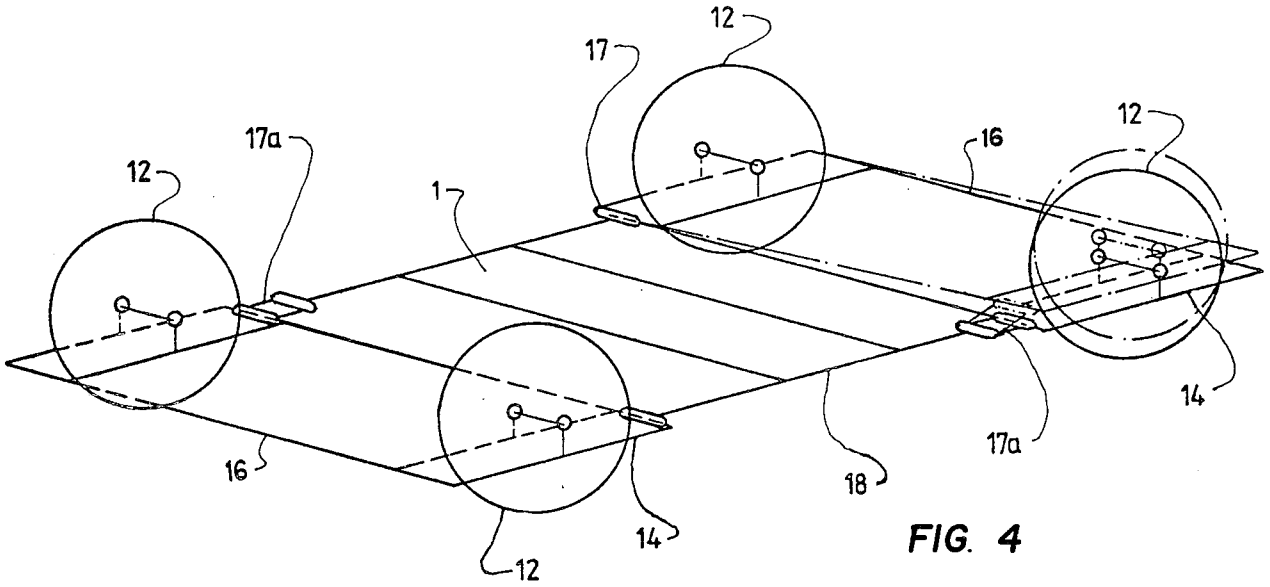
FIG. 4 is a principal sketch of the operating mechanism of the bogie when mounting a wheel.

Links 14 are connected at their inner ends **15*a* with side parts 18 of the bogie. One joint of each bogie is designed as a single joint 17 and the other joint as a double joint 17*a*, of each other diagonally. This use of the double joints 17*a* facilitates the crossing of the axles, as it happens, for example, in an overriding of the rail by the wheel flange (see FIG. 4). In their center, links 14 bear on an arm 20 of side frames or parts 18 with the interposition of a spring 19. These links 14, including wheels 12**, are spring-suspended relative to the rest of the bogie, so that an elaborate individual spring suspension of the wheels is not needed.

On side frames parts 18 of the bogie, the body of the car 30 is supported by the interposition of springs 21 (secondary suspension), which can also be pneumatic or hydraulic springs.

In FIGS. 2A and 2B, disk brakes are generally shown at 60.

The invention of this application is thus a bogie for a rail vehicle comprising, a hollow jacket 2 having at least one open face forming an electric motor housing, a stator winding assembly 3 in the hollow jacket, a rotatably mounted motor shaft 6, **6*a* in the stator winding assembly 3 having an axis extending in a travel direction of the vehicle, a crossbeam 1 having side parts 18 and connected directly to the hollow jacket 2, a motor bearing bracket 4 connected to and covering the at least one end face for rotatably receiving the motor shaft 6, 6*a*, a miter and differential gear housing connected to the bracket and including therein a miter and differential gear 5,5*a*,50 connected to said motor shaft 6,6*a*, a pair of Cardan shafts 9,9*a* with couplings 10,11 connected to said miter and differential gear, and a wheel with wheel axle 12** connected to each of said Cardan shafts and couplings.

The invention also comprises double member links 14 having inside ends adjacent a center of the bogie pivotally connected to the side parts 18 of the bogie (at **15*a*), and outside ends 15 connected to each other (through 16**).

While specific embodiments of the invention have been shown and described in detail to illustrate the application of the principles of the invention, it will be understood that the invention may be embodied otherwise without departing from such principles.

What is claimed is:

1. A bogie for a rail vehicle comprising:

a hollow jacket (2) having at least one open face and forming an electric motor housing;

a stator winding assembly (3) in said hollow jacket;

a rotatably arranged motor shaft (**6*a***) in said stator winding assembly having an axis extending in a travel direction of the vehicle;

a crossbeam (1) consisting of said parts and said hollow jacket;

a motor bearing bracket (31) connected to and covering said at least one end face for rotatably receiving said motor shaft;

a miter and differential gear housing (32) connected to said bracket and including therein a miter gear (**5*a*) and a differential gear (50**) connected to said motor shaft;

a pair of Cardan shafts (9, **9*a*) with couplings (10, 11, 11*a***) connected to said differential gear;

a wheel (12) with wheel axles connected to each of said Cardan shafts with couplings;

said motor bearing bracket (31) being formed as a part of said miter and differential gear housing (32) which is connected directly to said at least one face, said miter gear including a pinion mounted on pinion bearings (8) in the miter and differential gear housing, said motor shaft (**6*a***) mounted for rotation in said pinion bearings;

a double member link (14, 14) connected on both sides of each of said wheels to each wheel axle, each of said double member links having inside ends adjacent a center of said bogie and opposite outside ends, said inside ends being pivotally connected to said side parts of said cross beam, said outside ends of said double member links on one end of said bogie being connected to each other to frame said wheels with wheel axles, each of said double member links engaged with one of said side parts for supporting said side parts; and a hollow tube (16) connected between outside ends of said double member links on each end of said bogie.

2. A bogie according to claim 1 including extension arms extending from said side parts of said crossbeam and a spring connected between each of said extension arms and said double member links respectively.

3. A bogie according to claim 2 wherein each of said double member links comprise a pair of webs pivotally mounted to each other, said wheel with wheel axle rotatably connected at the pivotal connection between said webs, said spring connected at said pivotal connection between said webs.

4. A bogie according to claim 3 wherein said hollow jacket includes an opposite end face, an additional bearing bracket connected to and covering said opposite end face with an additional miter and differential gear housing with additional miter and differential gears connected to said bracket and motor shaft respectively, additional Cardan shafts and couplings connected to said additional miter and differential gear with additional wheels connected to said additional Cardan shafts and couplings, said additional wheels disposed on an end of the bogie opposite from said former mentioned wheels with wheel axles, additional double member links connected to said additional wheels having inside ends adjacent the center of the bogie pivotally connected to said side parts, and a double joint connected between diagonally opposite pivotal connections between said side part and said double member link inside ends.

* * * * *